United States Patent [19]

Baier et al.

[11] Patent Number: 4,538,131

[45] Date of Patent: Aug. 27, 1985

[54] AIR-CORE CHOKE COIL

[75] Inventors: Manfred Baier, Oberehrendingen; Andreas Rascher, Küttigen, both of Switzerland

[73] Assignee: BBC Brown, Boveri & Company, Ltd., Switzerland

[21] Appl. No.: 556,645

[22] Filed: Nov. 30, 1983

[30] Foreign Application Priority Data

Jan. 27, 1983 [CH] Switzerland ..... 442/83

[51] Int. Cl.[3] ..... H01F 27/08

[52] U.S. Cl. ..... 336/57; 336/60; 336/197; 336/207

[58] Field of Search ..... 336/207, 206, 185, 60, 336/197, 59, 57

[56] References Cited

U.S. PATENT DOCUMENTS

| | | | |
|---|---|---|---|
| 1,436,968 | 11/1922 | Lennox | 336/60 |
| 2,716,695 | 8/1955 | Cutliff et al. | 336/207 X |
| 3,320,567 | 5/1967 | Hoeft | 336/197 |
| 3,621,429 | 11/1971 | Benke | 336/207 X |
| 3,663,910 | 5/1972 | Grubb | 336/60 X |
| 3,696,315 | 10/1972 | Riggins | 336/207 X |
| 3,760,315 | 9/1973 | Hartmann | 336/207 X |
| 3,895,334 | 7/1975 | Baier | 336/197 X |
| 3,999,157 | 12/1976 | Philofsky et al. | 336/197 |
| 4,156,221 | 5/1979 | Graul | 336/59 |

FOREIGN PATENT DOCUMENTS

| | | | |
|---|---|---|---|
| 528164 | 6/1931 | Fed. Rep. of Germany | 336/207 |
| 2218018 | 9/1973 | Fed. Rep. of Germany . | |

OTHER PUBLICATIONS

Publication 231.1, Second Edition of 4, 1978, published by Haefly & Cie, AG.

Siemens Zeitschrift 44, 1970, H-10, pp. 613-617.

*Primary Examiner*—Thomas J. Kozma

*Attorney, Agent, or Firm*—Ostrolenk, Faber, Gerb & Soffen

[57] ABSTRACT

An axially symmetric air-core choke coil for high voltage applications. The coil includes a plurality of radially concentric, helically wound layers of windings. Non-insulated wire cable is used to produce each winding. Therefore, adjacent turns of each winding, as well as adjacent layers are spaced from one another. Separation between adjacent turns of each layer is provided through longitudinally extending, non-conductive, strips which are circumferentially spaced around the outer periphery of each winding layer. The strips are folded radially inward at the open spaces between turns. The layers are separated by a plurality of longitudinally extending non-conductive bars. The bars can be positioned to overlap the strips. Numerous air gaps are thereby defined between adjacent turns and adjacent layers which allow air to easily flow in a radial direction into the center of the air-core coil. A screen is provided at one axial end of the air-core coil to block the axial flow of air through the center of the air-core and to direct the axial air flow over the inner periphery of the air-core. This creates a Bernulli effect which reduces the air pressure within the air-core so that the radial air flow is substantially increased. Means are provided for axially compressing the windings of the coil to increase its mechanical strength to withstand disruptive forces which develop during short-circuit conditions.

14 Claims, 6 Drawing Figures

AIR-CORE CHOKE COIL

BACKGROUND OF THE INVENTION

The invention concerns an air-core choke coil, for use in high tension installations, and a method for its manufacturing. Air-core choke coils contain a helical winding, of a coil conductor, or several helical windings connected in parallel. The windings are formed into a helix by winding or bending the coil conductor, measures being employed to insulate sequential turns of a winding from one another.

Choke coils act to prevent rapid changes in the current magnitude and are also used for other various purposes. For example, they are useful as carrier frequency barriers, as short circuit choke coils for current limitation, as filter choke coils in resonant circuits, as current rise and smoothing choke coils, etc.

In a known air-core choke coil described in German Offenlegungsschrift 2,218,018, the coil has a winding in which the coil conductor is surrounded by insulating tapes and neighbouring windings are respectively bonded together. Such air-core choke coils are characterised by high mechanical strength and compactness but permit only axial air flow through the coil, which has an adverse affect on the cooling of the upper parts—particularly of the inner windings of multi-layer air-core choke coils. In addition, the magnetic field generated by the coil cannot escape from the coil conductor and cause eddy currents which further heat the coil.

Since the temperature of the coil conductor should remain below a certain limiting value, its cross-section must be enlarged to improve its efficiency cooling particularly when additional factors contribute further to heating it.

SUMMARY OF THE INVENTION

The object of the invention is to improve the cooling and substantially reduce the eddy current formation in air-core choke coils of the type considered and to provide a simple and cost-effective method of manufacturing choke coils according to the invention.

The invention, as characterised in the claims, creates an air-core choke coil, in which—in addition to the axial air flow—radial air flow means are provided also through an air gap formed between each two sequential turns due to a separation provided therebetween. The cooling thus being substantially improved particularly in the upper part of the air-core choke coil. This cooling improvement is particularly effective for inner windings of multi-layer choke coils. Due to the high mechanical stresses which are present during the occurrence of short circuits, an air-core choke coil must meet stringent requirements with respect to strength and vibration properties. These requirements are achieved by the air-core choke coil according to the invention, despite the use of a coil conductor of relatively low mechanical strength, by prestressing in the axial direction.

An air-core choke coil with separated turns is known (Publication 231.1, second edition of 4.1978, from the firm of Haefely & Cie. AG), in which a solid conductor is used as the coil conductor. This provides the necessary mechanical properties as well as good cooling and avoidance of eddy currents. However, the solid conductor is substantially more difficult to work with because it cannot be simply wound but must be bent, for example by means of a 3-roller bending device. In addition, a solid conductor is difficult to shape precisely and with a reasonable cost so that accurate balancing of the inductivities of parallel connected windings are obtained. This is, however, necessary for even distribution of the current between the windings, and it is therefore scarcely suitable for the construction of multi-layer coils. This means that only air-core choke coils of the type considered can offer—in addition to the other advantages of multi-layer coils such as compactness combined with high power—full utilization of radial air flow, which is particularly effective for inner windings cooling in multi-layer coils.

The advantages of the invention are achieved because of the improved cooling, the smaller cross-section of the coil conductor and consequent reduction in material and weight in the coil. In addition, insulation of the windings becomes unnecessary because of the separation between windings while, at the same time, the advantages of air-core choke coils of the type considered, such as simplicity of manufacture and possibility of accurate balancing and therefore of multi-layer construction, are retained. Also provided is a method for manufacturing an air-coil choke coil according to the invention, which method is simple to carry out and can be completely automated in individual cost effective process steps.

The invention is explained below in detail by reference to the drawings which illustrate an apparatus and method of the invention.

DETAILED DESCRIPTION OF THE DRAWINGS

Figure 1:
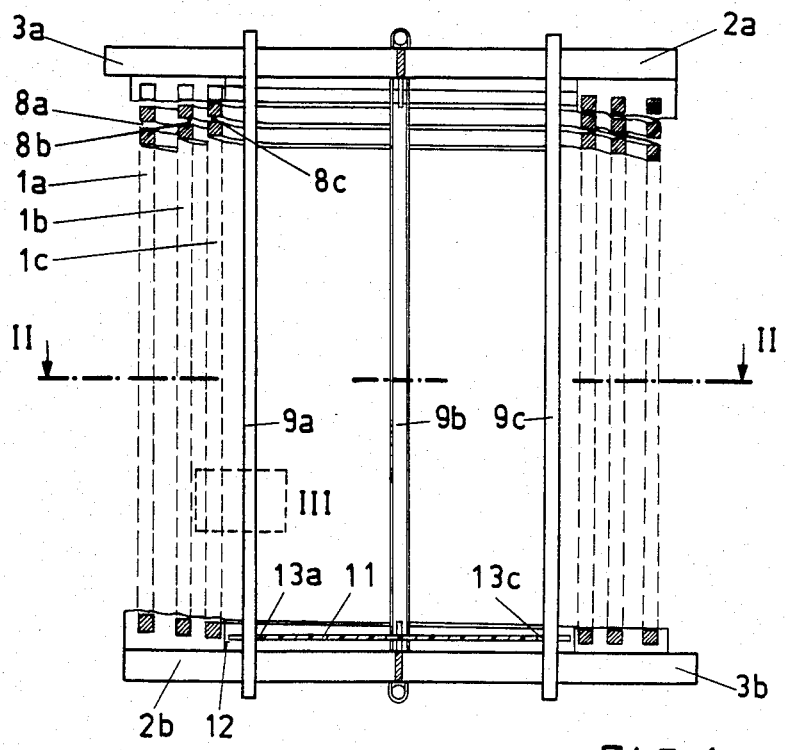
FIG. 1 shows an axial longitudinal section through a choke coil according to the invention.
Figure 2:
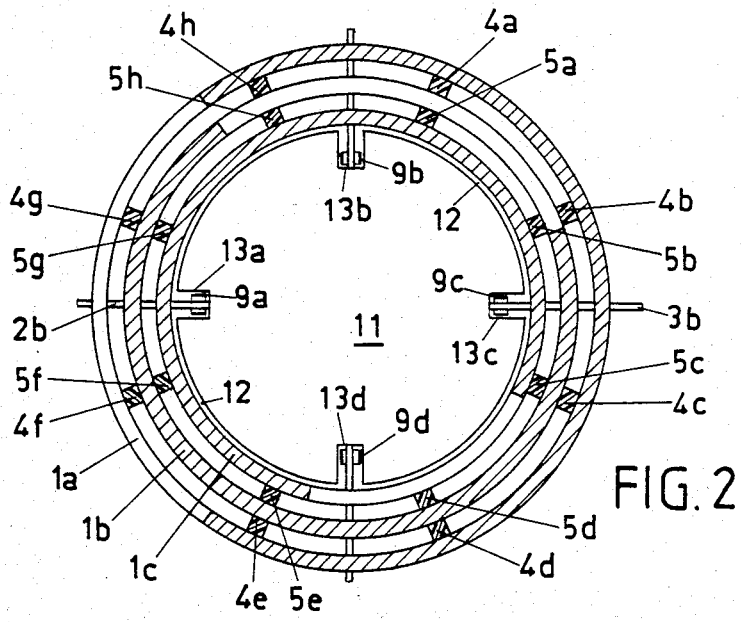
FIG. 2 shows a cross-section (along II—II in FIG. 1) through the same choke coil.
Figure 3:
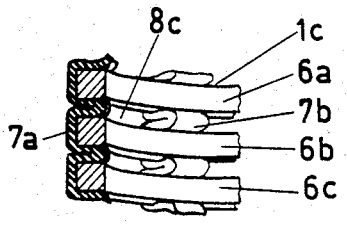
FIG. 3 shows an enlarged section from FIG. 1, corresponding to the rectangle III shown in broken lines in that Figure, with, in particular, the spacing means omitted from FIG. 1 for reasons of clarity being shown and the tension strip 9*a* being omitted.

The figures show an air-core choke coil, which, in its basic construction, contains three cylindrical windings 1*a, b, c* consisting of wire cable of approximately square cross-section, which windings have different radii and are enclosed coaxially with gaps provided therebetween. An upper support spider 2*a* and a lower support spider 2*b* are fastened to the upper and lower ends of the windings 1*a, b, c.* The support spiders consist of metal, and the ends of the windings 1*a, b, c* are connected to them so as to be electrically conducting. Protruding parts on the support spiders 2*a,* 2*b* serve as electrical connections 3*a,* 3*b.* The windings 1*a, b, c* are held apart by outer distance rods 4*a, b, c, d, e, f, g, h* and inner distance rods 5*a, b, c, d, e, f, g, h* (none of which are shown in FIG. 1), which consist of insulating material, for example fibre-reinforced plastic.

According to the invention, sequential turns of the individual windings 1*a, b, c* are respectively kept apart by several longitudinally extending spacers distributed around the periphery of the turns. The spacers are preferably formed by sections, which are insertable between sequential turns 6*a, b, c* . . . , and further include several insulating distance strips 7*a, b*, . . . which are distributed around the periphery of the respective winding. The spacers are in contact with the winding at the outside and run in substantially axial direction, or by groups of parallel superimposed distance strips, the turns forming air gaps 8*a, b, c* between them. The air gaps 8*a, b, c* permit the formation of a radially extending cooling air flow, which improves the cooling, particularly of the inner windings 1*b, c*. The width of the air gaps 8*a, b, c* is determined in each case by the thickness of the respective distance strips 7*a, b* . . . or groups of parallel superimposed distance strips and can be varied over a wide range. Blended fabrics with a high proportion of glass fibre have proved especially useful as the material best suited for the distance strips, because this material is very solid and is only compressible to a limited extent. This makes possible an accurate setting of the width of the air gap.

In addition, the air-core choke coil is prestressed in the axial direction, the amount of prestressing being fixed by mechanical parameters such as the strength of the coil conductor and the mechanical forces expected. For the fields of application especially pertinent here, it will generally be above 4t/winding, preferably between 6 and 8t/winding. The prestressing is maintained by tension strips 9*a, b, c, d*, preferably of glass fibre-reinforced plastic, extending between the support spiders 2*a, b*.

Figure 4:
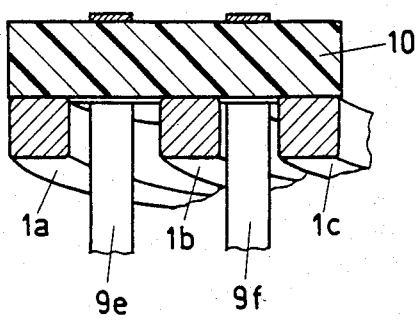
FIG. 4 shows, by means of a cross-section through the end turns of an air-core choke coil according to the invention, the method of fixing optional additional tension strips on the choke coil shown in FIGS. 1–3.

In order to obtain an even distribution of the compressive forces, it can be of advantage, particularly with choke coils of large diameter, to apply other tension strips. For this purpose, bridges 10, for example of fibre-reinforced plastic, can be applied at several points on the periphery of the choke coil at opposite ends of it. The bridges extend in the radial direction and are supported on the end turns of the windings 1*a, b, c*, and further tension strips 9*e, f*, . . . can be tensioned in the intermediate spaces between the windings 1*a, b, c* by means of the two opposing bridges 10 (FIG. 4). The employment of tension strips is, of course, also possible where support spiders are not provided.

The mechanical properties, in particular the vibration response, of the coil are substantially improved with prestressing. This effect is probably at least partially due to the fact that the force pressing the coil together in the axial direction, as occurs during a short circuit, is opposed by a strong elastic counterforce even with a slight deformation of the choke coil. On the other hand, such a counterforce would only build up in the case of a choke coil not prestressed in proportion to the deformation and in accordance with Hooke's law.

Figure 5:
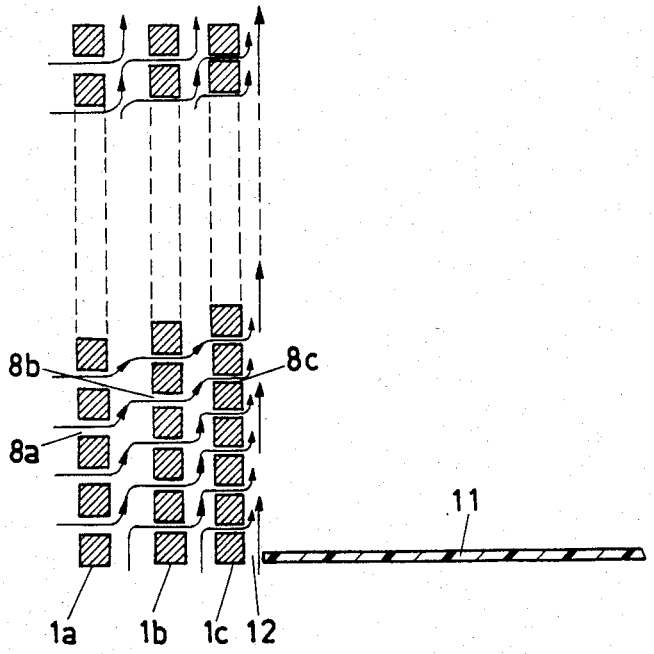
FIG. 5 shows a further, schematically drawn axial longitudinal section by means of which the principle of the cooling of the choke coil represented in the previous Figures is clarified.

Furthermore, the air-core choke coil has a screen 11, preferably disc shaped and located at the height of the lower end of the coil, which screen 11, together with the lower edge of the innermost winding 1*c*, forms a peripheral gap 12 of approximately 3 mm width, which gap is only interrupted by the recesses 13*a, b, c, d* for the strips 9*a, b, c, d*. The screen consists preferably of glass fibre-reinforced epoxy resin. It has been found that the application of the screen 11 substantially improves the cooling of the choke coil. In particular, the maximum excess temperature (hot spot) occurring in the upper coil region can be reduced by 20–30% by means of this measure. This unexpected effect may be due to the rise of the air warmed by the coil within the coil, cold air is drawn through the gap 12 and a laminar flow occurs along the inner boundary surface of the innermost winding 1*c*. Due to the flow, a pressure drop occurs therein in accordance with the Bernoulli equation and further cold air is induced flowing through the air gaps 8*a, b, c* between the turns of the windings 1*a, b, c*. The way in which the cooling air flows is shown schematically in FIG. 5.

This effect is not reduced notably by the addition of bird protection grids or a cover, for example resembling the screen 12, at the upper end of the coil, as is necessary under certain conditions.

A method for manufacturing the choke coil described above, representing only an exemplary embodiment of the method according to the invention of manufacturing an air-core choke coil, is described below.

The innermost winding 1*c* is first helically wound from wire cable of approximately square section on a cylindrical winding mandrel.

According to the invention, the winding takes place in such a way that an air gap 8*c* is generated between each two adjacent turns (for example, turns 6*a, b*).

After completion of the winding 1*c*, several distance strips 7*a, b*, . . . are applied around the periphery of the winding 1*c*, each distance strip 7*a, b* . . . being fixed in each case at one end of the winding 1*c*, preferably by means of a staple, and, axially extending towards the opposite end of the winding 1*c*. The ships 7*a, b*, are inserted by means of a spatula type insertion tool 14 into the intermediate spaces between adjacent turns 6*a, b* . . . to form the air gap 8*c* in such a way that the distance strip 7*a, b*, . . . is, in each case, in contact with the outside of each turn 6*a, b*, . . . . The distance strip (after reaching the opposite end of the winding 1*c*) is again fixed there.

Figure 6:
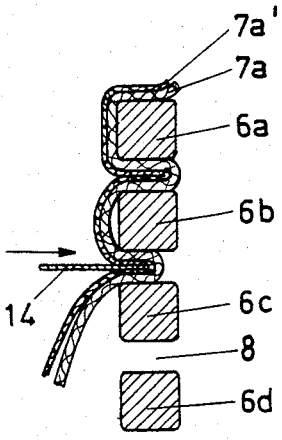
FIG. 6 shows, by means of a schematic cross-section through one part of a winding, the placing of the distance strips in the manufacture of the choke coil shown in FIGS. 1–3.

The looping-in of the distance strips 7*a, b*, . . . is shown in FIG. 6, the use, which is advantageous for a large width of the air gap 8, of a group of, in this case, two parallel superimposed distance strips 7*a, 7a'*, being shown instead of a single distance strip 7*a*.

The application of the distance strips in the manner just described, which is repeated in a similar manner for the windings 1*b, 1a* can be carried out in a fully automated manner.

After completing the innermost winding 1*c*, including the application of the distance strips, the inner distance rods 5*a–h* are applied to the innermost winding 1*c* and the central winding 1*b* is wound over the inner distance rods and provided with distance strips. During this process, care must be used to control the traction of the wire cable during the winding process, so that an even formation of the winding 1*b* is obtained and, in particular, no kinks in the coil conductor occur at the distance rods 5*a–h*.

After the application of the outer distance rods 4*a–h*, the outer winding 1*a* is produced in a manner fully analogous to the production of the central winding 1*b*.

The choke coil, which has been fully wound and provided with all the distance strips, is then pressed in the axial direction and provisionally held by means of packaging tapes. The pressing is preferably carried out in sectors because the forces which have to be applied are substantially reduced by this means.

After the provisional fixing, the choke coil is removed from the winding mandrel, the screen 11 and the support spiders 2*a, b* are then fitted, the complete choke coil is immersed in epoxy resin and the latter is then cured by heating the choke coil. The immersion in epoxy resin serves for corrosion protection and, in particular, the impregnation of the distance strips, which otherwise absorb water and change their mechanical and electrical properties. It would, of course, also be possible to use strips which had been previously impregnated.

After the epoxy resin is cured, the tension strips 9*a, b,* . . . of glass fibre-reinforced plastic are applied and, in order to produce the preloading, the tension strips are tensioned so that they stretch by 5–10 parts per thousand. The packaging tapes are then removed.

| List of Reference Signs | |
|---|---|
| 1a, b, c | Windings |
| 2a, b | Support spiders |
| 3a, b | ELectrical connections |
| 4a–h | Outer distance rods |
| 5a–h | Inner distance rods |
| 6a, b, c, | Turns |
| 7a, b, | Distance strips |
| 7a + 7a', | Groups of distance strips |
| 8, 8a, b, c | Air gaps |
| 9a, b, c, | Tension strips |
| 10 | Bridge |
| 11 | Screeen |
| 12 | Gap |
| 13a–d | Recesses in 11 |
| 14 | Spatula type insertion tool |

We claim:

1. An axially symmetric air-core choke coil, comprising:

at least one winding, said at least one winding having a plurality of helically wound, spaced apart, wire cable turns, said coil having an inner cylindrical periphery inside said coil and an outer periphery concentrically surrounding said inner periphery;

a plurality of axially extending, electrically non-conductive, strips, spaced circumferentially around said at least one winding, each strip including a plurality of folded sections, respective ones of said folded sections being fitted between respective adjacent turns, a plurality of air gaps being defined between said turns and said strips, said strips being arranged to permit radial and longitudinal air flow through said air gaps;

means for generating an axial air flow along said inner cylindrical periphery of said coil, said axial air flow being adapted to reduce the air pressure at said inner periphery to induce outside air to flow through said air gaps; said means for producing an axial air flow comprises a screen, said screen being adapted to block air flow through the center of one axial end of said coil and to define an axial gap between the circumferential periphery of said screen and said at least one winding of said coil, whereby air entering said axial gap is accelerated to produce said reduced air pressure along said inner periphery of said coil; and means for axially prestressing said at least one winding.

2. The coil as in claim 1, wherein said wire cable turns are rectangular in cross-section and wherein said strips extend parallel to eah other along an outer periphery of each said at least one winding.

3. The coil as in claim 2, which includes a plurality of concentric windings each having the structure of said at least one winding, each of said plurality of windings being electrically connected to one another in a predetermined circuit relation.

4. The coil as in claim 3, further comprising a plurality of axially extending, electrically non-conductive, rods spaced circumferentially between adjacent ones of said plurality of windings to provide a separation therebetween.

5. The coil as in claim 4, wherein said rods and said strips are generally overlapping.

6. The coil as in claim 2, wherein said strips are double-layered.

7. The coil as in claim 3, wherein said prestressing means comprise longitudinally extending tension strips and first and second spider supports located at first and second axial ends of said coil, said first and second spider supports being connected by said tension strips and being drawn together axially to compress said plurality of windings of said coil.

8. The coil as in claim 7, wherein said coil includes at least ten concentric windings and wherein said tension strips extend longitudinally at a location between a fourth and eighth winding of said coil.

9. The coil as in claim 8, wherein said tension strips are comprised of glass fiber reinforced plastic.

10. The coil as in claim 2, wherein said prestressing means comprises longitudinally extending tension strips and first and second bridges located at first and second axial ends of said coil, said first and second bridges being connected by said tension strips and being drawn together axially to compress said at least one winding of said coil.

11. The coil as in claim 10, wherein said tension strips are comprised of glass fiber reinforced plastic.

12. The coil as in claim 2, wherein the radial width of said gap is less than 15 mm.

13. The coil as in claim 12, wherein the radial width of said gap is between 2 mm and 5 mm.

14. The coil as in claim 13, wherein said screen consists of fiber-reinforced epoxy resin.

* * * * *